US012102869B2

(12) United States Patent
Hu

(10) Patent No.: US 12,102,869 B2
(45) Date of Patent: Oct. 1, 2024

(54) VERTICAL-COLUMN FOLDING MECHANISM AND FOLDABLE TREADMILL

(71) Applicant: Yongkang Saihan Electronic Technology Co., Ltd., Jinhua (CN)

(72) Inventor: Jiachen Hu, Jinhua (CN)

(73) Assignee: Yongkang Saihan Blectronic Technology Co Ltd., Yongkang (CN)

( * ) Notice: Subject to any disclaimer, the term of this patent is extended or adjusted under 35 U.S.C. 154(b) by 245 days.

(21) Appl. No.: 17/857,190

(22) Filed: Jul. 5, 2022

(65) Prior Publication Data

US 2022/0331650 A1 Oct. 20, 2022

(30) Foreign Application Priority Data

May 19, 2022 (CN) ..... 202221203268.1

(51) Int. Cl.
*A63B 22/02* (2006.01)

(52) U.S. Cl.
CPC ..... *A63B 22/02* (2013.01); *A63B 2210/54* (2013.01)

(58) Field of Classification Search
CPC ..... A63B 22/02; A63B 2210/54; A63B 2071/0063; A63B 2210/50; A63B 2210/56; A63B 22/025
See application file for complete search history.

(56) References Cited

U.S. PATENT DOCUMENTS 3,685,511 A * 8/1972 Alvarez ..... A61H 15/00 482/144
5,816,981 A * 10/1998 Hung ..... A63B 22/02 482/54
5,839,993 A * 11/1998 Fox ..... A63B 22/02 482/54
6,090,016 A * 7/2000 Kuo ..... A63B 22/02 482/54
6,383,120 B1 * 5/2002 Lo ..... A63B 22/02 482/54
6,758,791 B1 * 7/2004 Kuo ..... A63B 22/0023 482/54
6,857,991 B2 * 2/2005 Yu ..... A63B 22/02 482/54
6,890,287 B2 * 5/2005 Chen ..... A63B 22/02 482/54
6,916,277 B2 * 7/2005 Chen ..... A63B 22/02 482/54
6,979,283 B2 * 12/2005 Pan ..... A63B 22/02 482/54

(Continued)

*Primary Examiner* — Garrett K Atkinson

(57) ABSTRACT

The present disclosure discloses a vertical-column folding mechanism and a foldable treadmill. The vertical-column folding mechanism includes a first arm and a second arm; the first arm and the second arm are rotatably connected; a supporting member mounting cavity is arranged in the second arm; a retractable supporting member is arranged in the supporting member mounting cavity; two ends of the supporting member are respectively rotatably connected to the first arm and the second arm; and a rotatable connection point of the first arm and the second arm and rotatable connection points of the two ends of the supporting member are in a triangular distribution. The foldable treadmill includes the vertical-column folding mechanism.

8 Claims, 3 Drawing Sheets

(56) References Cited

U.S. PATENT DOCUMENTS 7,004,887 B2 * 2/2006 Pan ..... A63B 22/02 482/54
7,727,122 B2 * 6/2010 Kuo ..... A63B 22/0235 482/54
7,780,578 B2 * 8/2010 Packham ..... A63B 22/02 482/4
10,589,147 B1 * 3/2020 Kostadis ..... A63B 22/025
2004/0132585 A1 * 7/2004 Chen ..... A63B 22/02 482/54
2007/0191190 A1 * 8/2007 Kuo ..... A63B 22/0023 482/54
2008/0188358 A1 * 8/2008 Kuo ..... A63B 22/0235 482/54
2008/0234111 A1 * 9/2008 Packham ..... A63B 22/02 482/54
2009/0042698 A1 * 2/2009 Wang ..... A63B 22/02 482/54
2009/0062072 A1 * 3/2009 Packham ..... A63B 22/02 482/4
2009/0069159 A1 * 3/2009 Wang ..... A63B 22/02 482/54
2013/0130872 A1 * 5/2013 Benne ..... A63B 21/4023 482/121
2013/0237384 A1 * 9/2013 Huang ..... A63B 22/02 482/54
2014/0121066 A1 * 5/2014 Huang ..... A63B 22/02 482/54
2014/0221167 A1 * 8/2014 Wu ..... A63B 22/0235 482/54
2017/0106233 A1 * 4/2017 Yang ..... A63B 23/03516
2019/0290956 A1 * 9/2019 Ren ..... A63B 22/02
2020/0215380 A1 * 7/2020 Xing ..... A63B 22/025
2021/0299512 A1 * 9/2021 Kostadis ..... A63B 22/025

* cited by examiner

VERTICAL-COLUMN FOLDING MECHANISM AND FOLDABLE TREADMILL

TECHNICAL FIELD

The present disclosure belongs to the technical field of vertical-column folding mechanisms and treadmills, specifically to a vertical-column folding mechanism and a foldable treadmill.

BACKGROUND

In mechanical products, a vertical-column folding mechanism is a commonly used mechanism for reducing a storage space or changing a state of a product. The existing vertical-column folding mechanism generally includes a vertical column that is rotatably connected to a main body, and a retractable supporting member, two ends of which are respectively connected to the vertical column and the main body. Rotatable storage of the vertical column is achieved by retractable locating of the supporting member. In the prior art, since the supporting member is located outside the vertical column and the main body, the main body, the vertical column and the supporting member are triangular in an unfolded state. Therefore, in the unfolded state, the supporting member will occupy some additional spaces, which is not suitable for some mechanical products. For example, a main body of a foldable treadmill is a base with a cycling belt. A foldable vertical column is arranged on a base and can be used for handrails and installation of instruments and a control screen. The vertical column can be unfolded during use, and can be folded when not used, so as to reduce an occupied space. However, when the existing triangular vertical-column folding mechanism is in an unfolded state, there will be supporting members obliquely disposed on two sides of the belt, which will obstruct a user when the user gets onto and get off the belt and easily make the user tripped over. Therefore, the use experience of users is reduced.

SUMMARY

For the shortcomings in the prior art, the present disclosure provides a vertical-column folding mechanism and a foldable treadmill. In such a vertical-column folding mechanism and foldable treadmill, external supporting members are eliminated, so that the vertical-column folding mechanism will not have an oblique supporting member in an unfolded state, which reduces the volume of the vertical-column folding mechanism and prevents obstruction caused by the supporting member to users, thus improving the use experience of users.

In order to solve the above technical problems, the present disclosure provides the following technical solutions: A vertical-column folding mechanism includes a first arm and a second arm; the first arm and the second arm are rotatably connected; a supporting member mounting cavity is arranged in the second arm; a retractable supporting member is arranged in the supporting member mounting cavity; two ends of the supporting member are respectively rotatably connected to the first arm and the second arm; and a rotatable connection point of the first arm and the second arm and rotatable connection points of the two ends of the supporting member are in a triangular distribution. In such a vertical-column folding mechanism, external supporting members are eliminated, so that the vertical-column folding mechanism will not have an oblique supporting member in an unfolded state, which reduces the volume of the vertical-column folding mechanism and prevents obstruction caused by the supporting member to users, thus improving the use experience of users.

In the above-mentioned technical solution, preferably, the first arm is a main body or one part of the main body; the second arm is a vertical column or one part of the vertical column; and the second arm rotates with the extension and retraction of the supporting member. The first arm is used as the main body or one part of the main body, that is, when the supporting member extends or retracts, the first arm is stationary, but the second arm rotates with the extension and retraction of the supporting member.

In the above-mentioned technical solution, preferably, the first arm is a vertical column or one part of the vertical column, and the second arm is a main body or one part of the main body; and the first arm rotates with the extension and retraction of the supporting member. The second arm is used as the main body or one part of the main body, that is, when the supporting member extends or retracts, the second arm is stationary, but the first arm rotates with the extension and retraction of the supporting member.

In the above-mentioned technical solution, preferably, a joint of the supporting member and the first arm is located in the supporting member mounting cavity; and a side wall of the second arm is provided with an opening used for avoiding a rotatable connection mechanism of the supporting member and the first arm. By the adoption of the structure, the supporting member can be integrally mounted in the second arm. In the process that the first arm and the second arm rotate relatively, the supporting member may not be exposed, which prevents the obstruction caused by the supporting member to users, thus improving the use experience of users.

In the above-mentioned technical solution, preferably, the opening is an arc-shaped opening taking the rotatable connection point of the first arm and the second arm as a circle center.

In the above-mentioned technical solution, preferably, the supporting member is an air spring. The air spring is used as the supporting member, which can achieve automatic unfolding of the first arm and the second arm.

In the above-mentioned technical solution, preferably, the air spring is provided with an air spring lock switch which has a control lever; and the control lever is located on an outer side of the second arm. The air spring lock switch can fix the air spring at any length, so that the first arm and the second arm can be fixed at any angle, and the control lever is located on the outer side of the second arm, which can facilitate the operation.

A foldable treadmill includes a treadmill main body and a vertical column. The main body and the vertical column are rotatably connected through a vertical-column folding mechanism; the vertical-column folding mechanism includes a first arm and a second arm; the first arm and the second arm are rotatably connected; the main body includes one of the first arm and the second arm; the vertical column includes the other one of the first arm and the second arm; a supporting member mounting cavity is arranged in the second arm; a retractable supporting member is arranged in the supporting member mounting cavity; two ends of the supporting member are respectively rotatably connected to the first arm and the second arm; and a rotatable connection point of the first arm and the second arm and rotatable connection points of the two ends of the supporting member are in a triangular distribution. In such a foldable treadmill, external supporting members are eliminated, so that the vertical-column folding mechanism will not have an oblique supporting member in an unfolded state, which reduces the volume of the vertical-column folding mechanism and prevents obstruction caused by the supporting member to users, thus improving the use experience of users.

In the above-mentioned technical solution, preferably, a joint of the supporting member and the first arm is located in the supporting member mounting cavity; and a side wall of the second arm is provided with an opening used for avoiding a rotatable connection mechanism of the supporting member and the first arm. By the adoption of the structure, the supporting member can be integrally mounted in the second arm. In the process that the first arm and the second arm rotate relatively, the supporting member may not be exposed, which prevents the obstruction caused by the supporting member to users, thus improving the use experience of users.

In the above-mentioned technical solution, preferably, the supporting member is an air spring which is provided with an air spring lock switch having a control lever; and the control lever is located on an outer side of the second arm. The air spring is used as a supporting member, which can achieve automatic unfolding of the first arm and the second arm. The air spring lock switch can fix the air spring at any length, so that the first arm and the second arm can be fixed at any angle, and the control lever is located on the outer side of the second arm, which can facilitate the operation.

Compared with the prior art, the present disclosure has the following beneficial effects: In such a vertical-column folding mechanism and foldable treadmill, external supporting members are eliminated, so that the vertical-column folding mechanism will not have an oblique supporting member in an unfolded state, which reduces the volume of the vertical-column folding mechanism and prevents obstruction caused by the supporting member to users, thus improving the use experience of users.

DETAILED DESCRIPTION OF THE EMBODIMENTS

Figure 1:
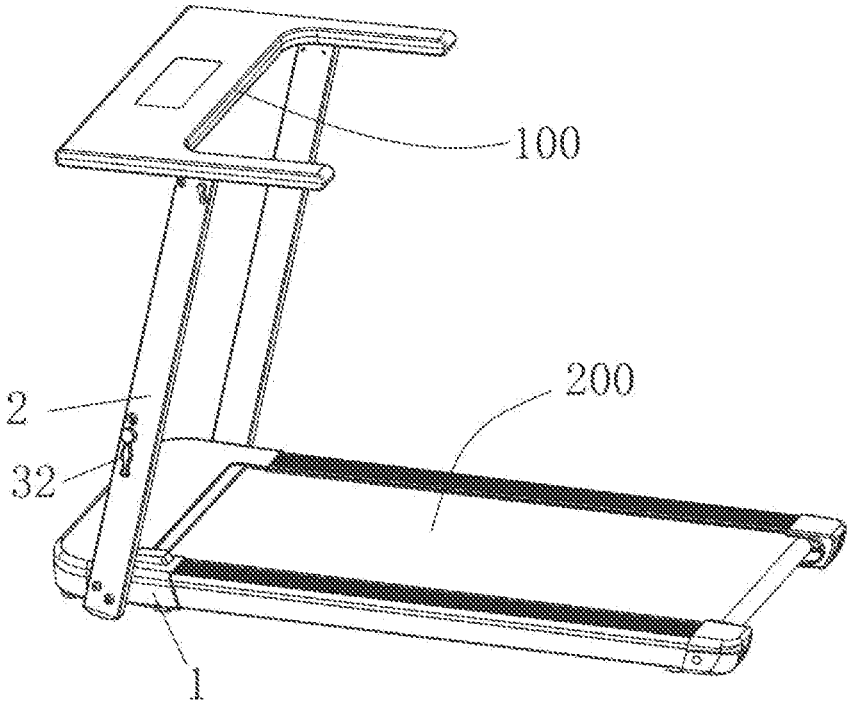
FIG. 1 is a schematic structural diagram of a vertical-column folding mechanism in the embodiments of the present disclosure when it is applied to a foldable treadmill.
Figure 2:
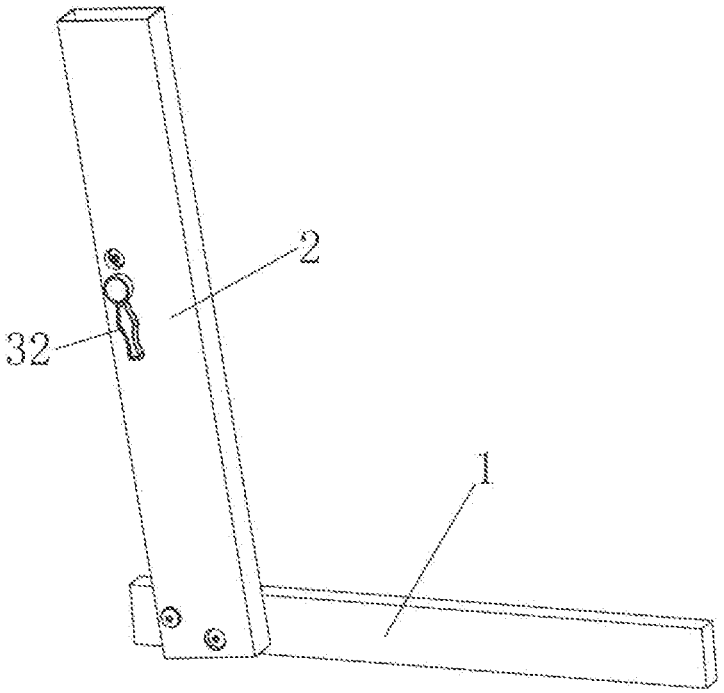
FIG. 2 is a schematic structural diagram of a vertical-column folding mechanism in the embodiments of the present disclosure in an unfolded state.
Figure 3:
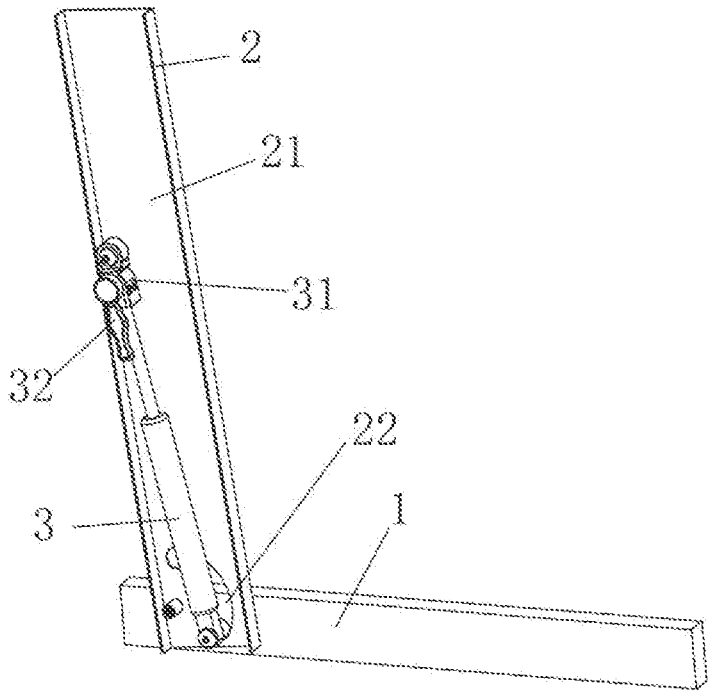
FIG. 3 is a schematic internally structural diagram of a vertical-column folding mechanism in the embodiments of the present disclosure in an unfolded state.
Figure 4:
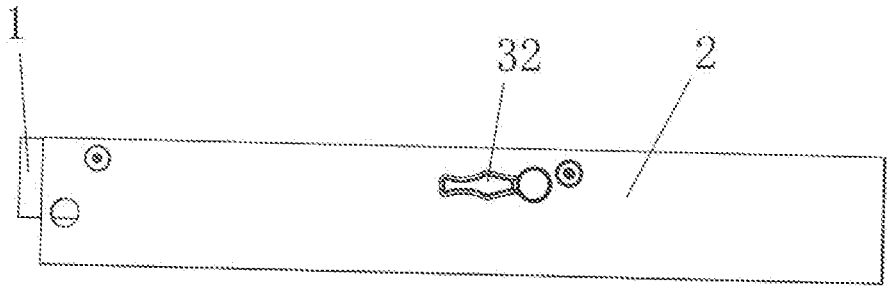
FIG. 4 is a schematic structural diagram of a vertical-column folding mechanism in the embodiments of the present disclosure in a folded state.
Figure 5:
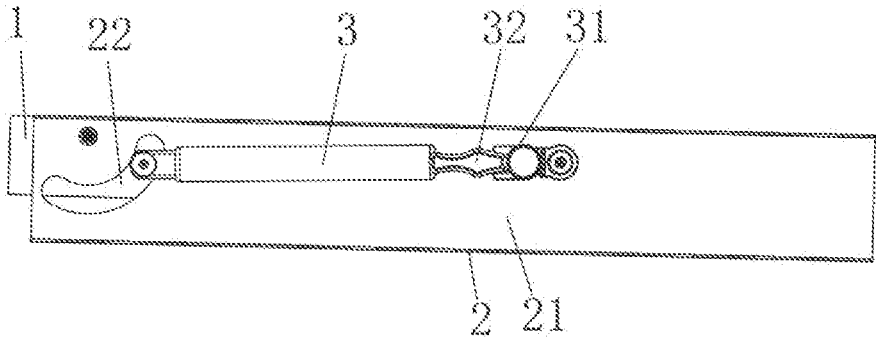
FIG. 5 is a schematic internally structural diagram of a vertical-column folding mechanism in the embodiments of the present disclosure in a folded state.

The present disclosure is further described in detail below in combination with the accompanying drawings and specific implementations: Referring to FIG. 1 to FIG. 5, a vertical-column folding mechanism includes a first arm 1 and a second arm 2. The first arm 1 and the second arm 2 are rotatably connected; a supporting member mounting cavity 21 is arranged in the second arm 2; a retractable supporting member 3 is arranged in the supporting member mounting cavity 21; two ends of the supporting member 3 are respectively rotatably connected to the first arm 1 and the second arm 2; and a rotatable connection point of the first arm 1 and the second arm 2 and rotatable connection points of the two ends of the supporting member 3 are in a triangular distribution. The first arm 1 and the second arm 2 can rotate relatively through extension and retraction of the supporting member 3. When the supporting member 3 is in an extended state, the first arm 1 and the second arm 2 are unfolded. When the supporting member 3 is in a retracted state, the first arm 1 and the second arm 2 are closed up. In such a vertical-column folding mechanism, external supporting members are eliminated, so that the vertical-column folding mechanism will not have an oblique supporting member in an unfolded state, which reduces the volume of the vertical-column folding mechanism and prevents obstruction caused by the supporting member to users, thus improving the use experience of users.

In this embodiment, the first arm 1 is one part of the main body 200, and the second arm 2 is one part of the vertical column 100. The second arm 2 rotates with extension and retraction of the supporting member 3. That is, when the supporting member 3 extends and retracts, the first arm 1 does not rotate, but the second arm 2 rotates with the extension and retraction of the supporting member 3.

Of course, those skilled in the art easily understand that in other embodiments, for structures of different products, the first arm 1 can be the main body 200, and the second arm 2 may be the vertical column 100.

Furthermore, in other embodiments, the first arm 1 may also be the vertical column 100 or one part of the vertical column 100, and the second arm 2 may also be the main body 200 or one part of the main body 200. The first arm 1 rotates with the extension and retraction of the supporting member 3. That is, when the supporting member 3 extends and retracts, the second arm 2 does not rotate, but the first arm 1 rotates with the extension and retraction of the supporting member 3.

In this embodiment, a joint of the supporting member 3 and the first arm 1 is located in the supporting member mounting cavity 21; a side wall of the second arm 2 is provided with an opening 22 used for avoiding a rotatable connection mechanism of the supporting member 3 and the first arm 1. By the structure, the supporting member 3 can be integrally mounted in the second arm 2. In the process that the first arm 1 and the second arm 2 rotate relatively, the supporting member 3 may not be exposed, which prevents the obstruction caused by the supporting member 3 to users, thus improving the use experience of users.

In this embodiment, the opening 22 is an arc-shaped opening taking the rotatable connection point of the first arm 1 and the second arm 2 as a circle center.

In this embodiment, the supporting member 3 is an air spring. The air spring is used as a supporting member 3, which can achieve automatic unfolding of the first arm 1 and the second arm 2. Those skilled in the art easily understand that when the air spring is used as the supporting member 3, it can be considered that a locating structure is arranged between the first arm 1 and the second arm 2 in the closed-up state, so as to locate the supporting member in the closed-up state.

In this embodiment, the air spring is provided with an air spring lock switch 31 which has a control lever 32; and the control lever 32 is located on an outer side of the second arm 2. The air spring lock switch 31 can fix the air spring at any length, so that the first arm 1 and the second arm 2 can be fixed at any angle, and the control lever 32 is located on the outer side of the second arm 2, which can facilitate the operation. A specific structure of the air spring lock switch 31 in this embodiment can refer to the structure off an air spring lock switch disclosed in CN2018214013320.

Referring to FIG. 1 to FIG. 5, a foldable treadmill includes a treadmill main body 200 and a vertical column 100. The main body 200 and the vertical column 100 are rotatably connected through a vertical-column folding mechanism. The vertical-column folding mechanism includes a first arm 1 and a second arm 2. The first arm 1 and the second arm 2 are rotatably connected; the main body 200 includes the first arm 1, and the vertical column 100 includes the second arm 2; a supporting member mounting cavity 21 is arranged in the second arm 2; a retractable supporting member 3 is arranged in the supporting member mounting cavity 21; two ends of the supporting member 3 are respectively rotatably connected to the first arm 1 and the second arm 2; and a rotatable connection point of the first arm 1 and the second arm 2 and rotatable connection points of the two ends of the supporting member 3 are in a triangular distribution. The first arm 1 and the second arm 2 can rotate relatively through extension and retraction of the supporting member 3. When the supporting member 3 is in an extended state, the first arm 1 and the second arm 2 are unfolded, that is, the vertical column 100 rises up. When the supporting member 3 is in a retracted state, the first arm 1 and the second arm 2 are closed up, that is, the vertical column 100 falls down. In such a vertical-column folding mechanism, external supporting members are eliminated, so that the vertical-column folding mechanism will not have an oblique supporting member in an unfolded state, which reduces the volume of the vertical-column folding mechanism and prevents obstruction caused by the supporting member to users, thus improving the use experience of users.

Those skilled in the art easily understand that in other embodiments, the main body 200 may also include the second arm 2, and the vertical column 100 includes the first arm 1, that is, the supporting member 3 is arranged in the main body 200. This is also regarded as the protection scope of the present disclosure.

In this embodiment, a joint of the supporting member 3 and the first arm 1 is located in the supporting member mounting cavity 21; a side wall of the second arm 2 is provided with an opening 22 used for avoiding a rotatable connection mechanism of the supporting member 3 and the first arm 1. By the structure, the supporting member 3 can be integrally mounted in the second arm 2. In the process that the first arm 1 and the second arm 2 rotate relatively, the supporting member 3 may not be exposed, which prevents the obstruction caused by the supporting member 3 to users, thus improving the use experience of users. The opening 22 is an arc-shaped opening taking the rotatable connection point of the first arm 1 and the second arm 2 as a circle center.

In this embodiment, the supporting member 3 is an air spring. The air spring is provided with an air spring lock switch 31 which has a control lever 32; and the control lever 32 is located on an outer side of the second arm 2. The air spring is used as the supporting member 3, which can achieve automatic unfolding of the first arm 1 and the second arm 2. The air spring lock switch 31 can fix the air spring at any length, so that the first arm 1 and the second arm 2 can be fixed at any angle, and the control lever 32 is located on the outer side of the second arm 2, which can facilitate the operation. A specific structure of the air spring lock switch 31 in this embodiment can refer to the structure off an air spring lock switch disclosed in CN2018214013320.

The above contents are preferred implementations of the present disclosure. It should be noted that those of ordinary skill in the art can further make several improvements and retouches without departing from the principles of the present disclosure. These improvements and retouches shall all fall within the protection scope of the present disclosure.

What is claimed is:

1. A vertical-column folding mechanism, comprising a first arm (1) and a second arm (2), wherein the first arm (1) and the second arm (2) are rotatably connected; a supporting member mounting cavity (21) is arranged in the second arm (2); a supporting member (3) is retractable and arranged in the supporting member mounting cavity (21); two ends of the supporting member (3) are respectively rotatably connected to the first arm (1) and the second arm (2); and a rotatable connection point of the first arm (1) and the second arm (2) and rotatable connection points of the two ends of the supporting member (3) are in a triangular distribution, wherein a joint of the supporting member (3) and the first arm (1) is located in the supporting member mounting cavity (21); a side wall of the second arm (2) is provided with an opening (22) used for avoiding a rotatable connection mechanism of the supporting member (3) and the first arm (1).

2. The vertical-column folding mechanism according to claim 1, wherein the first arm (1) is a main body (200) or one part of the main body (200); the second arm (2) is a vertical column (100) or one part of the vertical column (100); and the second arm (2) rotates with the extension and retraction of the supporting member (3).

3. The vertical-column folding mechanism according to claim 1, wherein the first arm (1) is a vertical column (100) or one part of the vertical column (100), and the second arm (2) is a main body (200) or one part of the main body (200); and the first arm (1) rotates with the extension and retraction of the supporting member (3).

4. The vertical-column folding mechanism according to claim 1, wherein the opening (22) is an arc-shaped opening taking the rotatable connection point of the first arm (1) and the second arm (2) as a circle center.

5. The vertical-column folding mechanism according to any one of claims 1, 2, 3 and 4, wherein the supporting member (3) is an air spring.

6. The vertical-column folding mechanism according to claim 5, wherein the air spring is provided with an air spring lock switch (31) which has a control lever (32); and the control lever (32) is located on an outer side of the second arm (2).

7. A foldable treadmill, comprising a treadmill main body (200) and a vertical column (100), wherein the main body (200) and the vertical column (100) are rotatably connected through a vertical-column folding mechanism; the vertical-column folding mechanism comprises a first arm (1) and a second arm (2); the first arm (1) and the second arm (2) are rotatably connected; the main body (200) comprises one of the first arm (1) and the second arm (2); the vertical column (100) comprises the other one of the first arm (1) and the second arm (2); a supporting member mounting cavity (21) is arranged in the second arm (2); a supporting member (3) is retractable and arranged in the supporting member mounting cavity (21); two ends of the supporting member (3) are respectively rotatably connected to the first arm (1) and the second arm (2); and a rotatable connection point of the first arm (1) and the second arm (2) and rotatable connection points of the two ends of the supporting member (3) are in a triangular distribution, wherein a joint of the supporting member (3) and the first arm (1) is located in the supporting member mounting cavity (21); and a side wall of the second arm (2) is provided with an opening (22) used for avoiding a rotatable connection mechanism of the supporting member (3) and the first arm (1).

8. The foldable treadmill according to claim 7, wherein the supporting member (3) is an air spring which is provided with an air spring lock switch (31) having a control lever (32); and the control lever (32) is located on an outer side of the second arm (2).

* * * * *